US009319806B2

(12) United States Patent
Ku et al.

(10) Patent No.: US 9,319,806 B2
(45) Date of Patent: Apr. 19, 2016

(54) METHOD AND APPARATUS FOR LOW POWER OPERATION OF BINAURAL HEARING AID

(71) Applicants: SAMSUNG ELECTRONICS CO., LTD., Suwon-si (KR); The Industry & Academic Cooperation in Chungnam National University (IAC), Daejeon (KR)

(72) Inventors: Yun Seo Ku, Seoul (KR); Jong Jin Kim, Hwaseong-si (KR); Jun Il Sohn, Yongin-si (KR); Jong Hee Han, Seoul (KR); Dong Wook Kim, Seoul (KR); Ji Hoon Kim, Seongnam-si (KR)

(73) Assignees: Samsung Electronics Co., Ltd., Suwon-si (KR); THE INDUSTRY & ACADEMIC COOPERATION IN CHUNGNAM NATIONAL UNIVERSITY (IAC), Daejeon (KR)

( * ) Notice: Subject to any disclaimer, the term of this patent is extended or adjusted under 35 U.S.C. 154(b) by 0 days.

(21) Appl. No.: 14/156,982

(22) Filed: Jan. 16, 2014

(65) Prior Publication Data

US 2014/0307901 A1 Oct. 16, 2014

(30) Foreign Application Priority Data

Apr. 16, 2013 (KR) ..... 10-2013-0041752

(51) Int. Cl.
*H04R 25/00* (2006.01)

(52) U.S. Cl.
CPC ..... *H04R 25/552* (2013.01); *H04R 25/305* (2013.01); *H04R 25/55* (2013.01); *H04R 25/554* (2013.01); *H04R 2225/31* (2013.01); *H04R 2460/03* (2013.01)

(58) Field of Classification Search
CPC .... H04R 25/30; H04R 25/505; H04R 25/552; H04R 25/554; H04R 25/556; H04R 25/558; H04R 2225/31; H04R 2225/33; H04R 2225/55; H04R 2460/03; H04R 25/305
USPC ..... 381/312, 314, 315, 323, 23.1, 60, 328, 381/331; 455/41.1, 41.2, 574
See application file for complete search history.

(56) References Cited

U.S. PATENT DOCUMENTS

| | | | | |
|---|---|---|---|---|
| 5,598,098 | A * | 1/1997 | Champlin | 324/430 |
| 5,598,466 | A * | 1/1997 | Graumann | 379/388.04 |
| 5,956,330 | A * | 9/1999 | Kerns | 370/336 |
| 6,320,969 | B1 * | 11/2001 | Killion | 381/323 |
| 6,415,034 | B1 * | 7/2002 | Hietanen | 381/71.6 |
| 6,549,633 | B1 * | 4/2003 | Westermann | 381/312 |
| 6,839,447 | B2 * | 1/2005 | Nielsen et al. | 381/312 |
| 7,020,296 | B2 * | 3/2006 | Niederdrank | 381/315 |
| 7,577,267 | B2 * | 8/2009 | Barthel et al. | 381/315 |
| 8,121,298 | B2 * | 2/2012 | Ochi et al. | 381/23.1 |
| 2002/0048382 | A1 * | 4/2002 | Hou | 381/323 |
| 2003/0037200 | A1 | 2/2003 | Mitchler | |
| 2004/0052391 | A1 | 3/2004 | Bren et al. | |
| 2006/0023907 | A1 | 2/2006 | Kasztelan | |
| 2008/0260191 | A1 | 10/2008 | Victorian et al. | |

(Continued)

*Primary Examiner* — Huyen D Le
(74) *Attorney, Agent, or Firm* — NSIP Law

(57) ABSTRACT

Provided is a method and apparatus for low power operation of a binaural hearing aid, the method including determining whether a residual battery exceeds a predetermined threshold level, collecting an external audio signal, in response to whether the residual battery exceeds the predetermined threshold level, and transmitting the collected audio signal to a second hearing aid.

25 Claims, 7 Drawing Sheets

(56) References Cited

U.S. PATENT DOCUMENTS

2009/0074216 A1* 3/2009 Bradford et al. ..... 381/315
2012/0087505 A1 4/2012 Popovski et al.
2013/0108058 A1* 5/2013 Launer et al. ..... 381/23.1
2013/0272556 A1* 10/2013 Hamacher ..... 381/328

* cited by examiner

METHOD AND APPARATUS FOR LOW POWER OPERATION OF BINAURAL HEARING AID

CROSS-REFERENCE TO RELATED APPLICATIONS

This application claims the benefit under 35 U.S.C. §119 (a) of Korean Patent Application No. 10-2013-0041752, filed on Apr. 16, 2013, in the Korean Intellectual Property Office, the entire disclosure of which is incorporated herein by reference for all purposes.

BACKGROUND

1. Field

The following description relates to a method and apparatus for low power operation of a wireless binaural hearing aid.

2. Description of Related Art

A hearing aid refers to a device worn by a user to assist in clear perception of sounds generated around the user. A binaural hearing aid may provide a user with clearer and more accurate sounds by performing data communication between a first hearing aid and a second hearing aid. Such a binaural hearing aid is used by a large number of people.

In order to improve the performance of the binaural hearing aid, research has been conducted on various aspects, such as, for example, a scheme of reconstructing a connection between various signal processing blocks provided in a binaural hearing aid, depending on a situation, a scheme of transferring messages between devices for resolving an issue of impeded communication between devices that is caused by a movement of a user. Recent research has been directed to improve the efficiency of a binaural hearing aid.

SUMMARY

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

In one general aspect, there is provided a method for low power binaural function operation of a first hearing aid, the method including determining whether a residual battery exceeds a predetermined threshold level; collecting an external audio signal, in response to determining whether the residual battery exceeds the predetermined threshold level; and transmitting the collected audio signal to a second hearing aid.

The method may include transmitting, to the second hearing aid, a control signal to suspend the binaural function, in response to the residual battery being less than or equal to the predetermined threshold level.

The method may include setting an operating mode to a low power mode in which the binaural function is not performed, in response to the residual battery being less than or equal to the predetermined threshold level.

The method may include generating an alert comprising at least one of an alerting sound or an alerting oscillation, in response to the residual battery being less than or equal to the predetermined threshold level.

The determining may comprise determining at predetermined intervals whether the residual battery exceeds the predetermined threshold level.

The determining may comprise determining at irregular intervals whether the residual battery exceeds the predetermined threshold level.

The method may include transmitting, to the second hearing aid, a control signal to perform the binaural function, in response to the residual battery being more than the predetermined threshold level.

The method may include setting an operating mode to a normal mode in which the binaural function is performed, in response to the residual battery being more than the predetermined threshold level.

The method may include receiving, from the second hearing aid, a processed audio signal.

The processed audio signal may comprise the collected audio signal processed by the second hearing aid.

The processed audio signal may comprise the collected audio signal and a audio signal collected by the second hearing aid, which are processed by the second hearing aid.

In another general aspect, there is provided a method for low power binaural function operation of a first hearing aid, the method including collecting an external audio signal; determining whether the collected audio signal corresponds to a meaningful signal, using a voice activity detector (VAD); and transmitting the collected audio signal to a second hearing aid, in response to whether the audio signal corresponds to a meaningful signal.

The method may include transmitting, to the second hearing aid, a control signal to suspend the binaural function, in response to the audio signal not corresponding to a meaningful signal.

The method may include setting an operating mode to a low power mode in which the binaural function is not performed, in response to the audio signal not corresponding to a meaningful signal.

The collecting may comprise collecting the external audio signal at a predetermined intervals.

The method may include transmitting, to the second hearing aid, a control signal to perform the binaural function, in response to the audio signal corresponding to a meaningful signal.

The method may include setting an operating mode to a normal mode in which the binaural function is performed, in response to the audio signal corresponding to a meaningful signal.

In another general aspect, there is provided a method for low power binaural function operation of a first hearing aid, the method including determining whether a residual battery exceeds a predetermined threshold level; collecting an external audio signal, in response to determining whether the residual battery exceeds the predetermined threshold level; determining whether the collected audio signal corresponds to a meaningful signal, using a voice activity detector (VAD); and transmitting the collected audio signal to a second hearing aid, in response to determining whether the audio signal corresponds to a meaningful signal.

In another general aspect, there is provided a method for low power binaural function operation of a first hearing aid, the method including receiving one of an audio signal and a control signal from a second hearing aid; determining whether the received signal corresponds to the audio signal or the control signal; and setting an operating mode corresponding to the control signal, in response to determining whether the received signal corresponds to the audio signal or the control signal.

The setting may include setting the operating mode to a low power mode in which the binaural function is not performed, in response to the control signal corresponding to a control signal to suspend the binaural function.

The setting may include setting the operating mode to a normal mode in which the binaural function is performed, in response to the control signal corresponding to a control signal to perform the binaural function.

The method may include performing signal processing with respect to the audio signal, in response to the received signal corresponding to the audio signal.

The performing signal processing may include signal processing the received audio signal and an audio signal collected by the first hearing aid.

In another general aspect, there is provided an apparatus for low power binaural function operation, the apparatus including a residual battery quantity determiner configured to determine whether a residual battery exceeds a predetermined threshold level; an audio signal collector configured to collect an external audio signal; an audio signal determiner configured to determine whether the collected audio signal corresponds to a meaningful signal; and an audio signal transmitter configured to transmit at least one of an audio signal or a control signal to a hearing aid.

Other features and aspects will be apparent from the following detailed description, the drawings, and the claims.

Figure 1A:
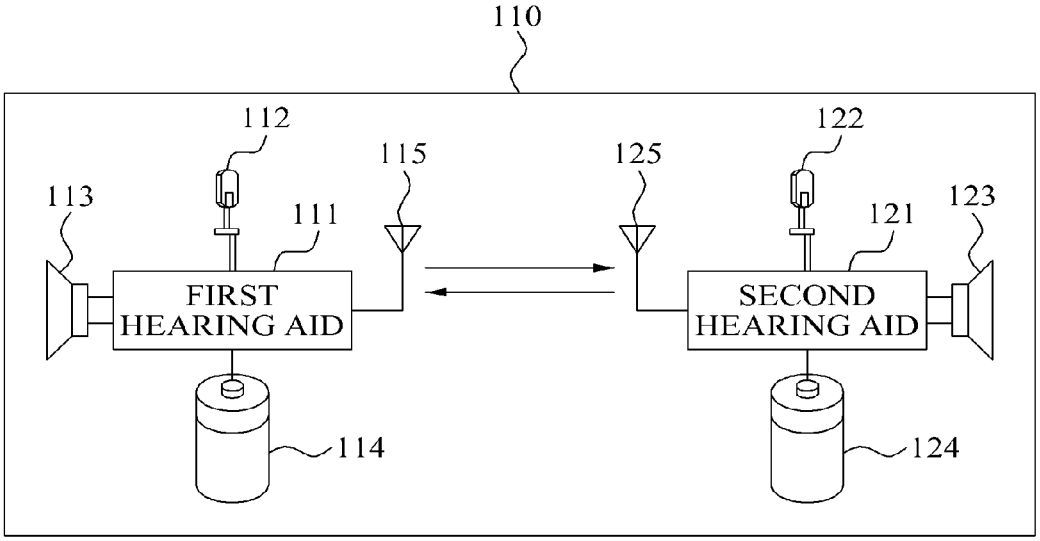
FIGS. 1A and 1B are diagrams illustrating examples of a hearing aid supporting a binaural function.

Throughout the drawings and the detailed description, unless otherwise described or provided, the same drawing reference numerals will be understood to refer to the same elements, features, and structures. The drawings may not be to scale, and the relative size, proportions, and depiction of elements in the drawings may be exaggerated for clarity, illustration, and convenience.

DETAILED DESCRIPTION

The following detailed description is provided to assist the reader in gaining a comprehensive understanding of the methods, apparatuses, and/or systems described herein. However, various changes, modifications, and equivalents of the systems, apparatuses and/or methods described herein will be apparent to one of ordinary skill in the art. The progression of processing steps and/or operations described is an example; however, the sequence of and/or operations is not limited to that set forth herein and may be changed as is known in the art, with the exception of steps and/or operations necessarily occurring in a certain order. Also, descriptions of functions and constructions that are well known to one of ordinary skill in the art may be omitted for increased clarity and conciseness.

The features described herein may be embodied in different forms, and are not to be construed as being limited to the examples described herein. Rather, the examples described herein have been provided so that this disclosure will be thorough and complete, and will convey the full scope of the disclosure to one of ordinary skill in the art.

Figure 1B:
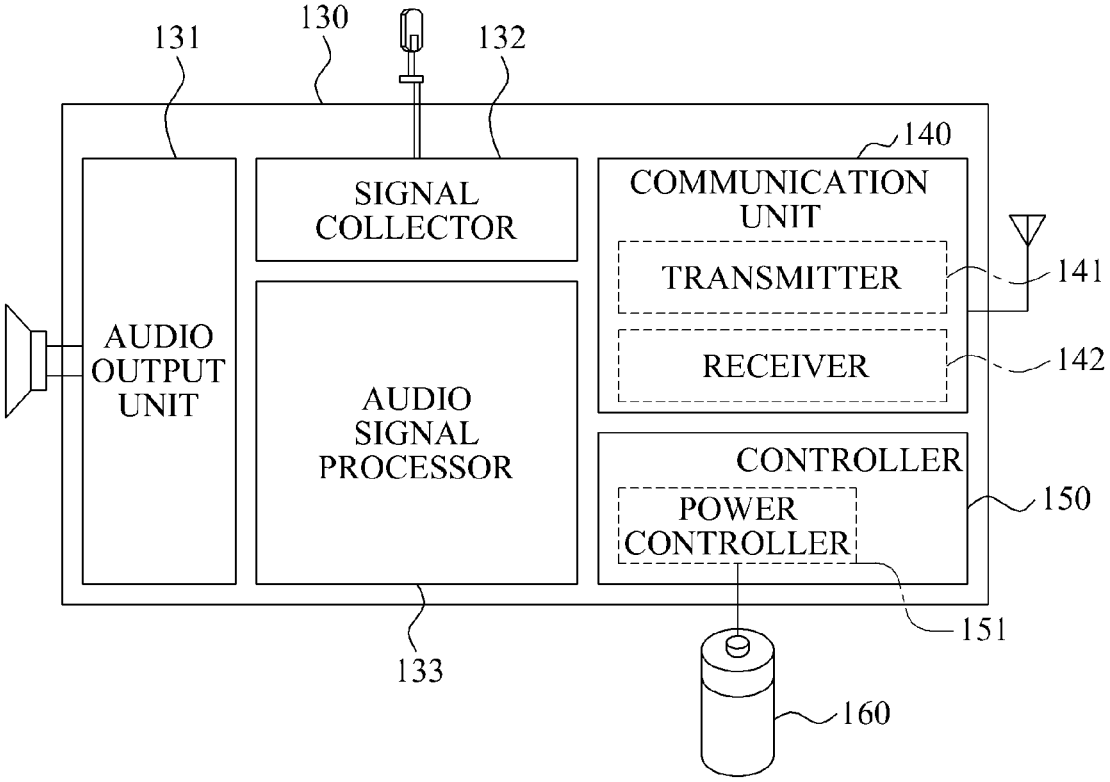

FIGS. 1A and 1B are diagrams illustrating examples of a hearing aid supporting a binaural function. Referring to FIG. 1A, a hearing aid 110 supporting a binaural function includes a first hearing aid 111 and a second hearing aid 121. The first hearing aid 111 includes a signal collector 112, an audio output unit 113, a battery 114, and a communication unit 115. The second hearing aid 121 includes a signal collector 122, an audio output unit 123, a battery 124, and a communication unit 125. The first hearing aid 111 and the second hearing aid 121 may transmit and receive a signal or data to and from each other for supporting the binaural function. The signal may include, but is not limited to, an audio signal and a control signal. Although the hearing aid 110 supporting the binaural function is described in terms of separate configurations for the first hearing aid 111 and the second hearing aid 121, the first hearing aid 111 and the second hearing aid 121 may be used interchangeably without departing from the spirit and scope of the illustrative examples described.

The first hearing aid 111 may collect an audio signal through the signal collector 112, and transmit the collected audio signal to the second hearing aid 121 periodically or as required. The second hearing aid 121 may process, using a predetermined signal processing scheme, an audio signal collected by the second hearing aid 121 and an audio signal received from the first hearing aid 111. The second hearing aid 121 may transmit the processed audio signals to the first hearing aid 111. The first hearing aid 111 and the second hearing aid 121 may output the processed audio signals to a user, thereby performing a role as hearing aids.

Referring to FIG. 1B, a hearing aid 130 corresponding to the first hearing aid 111 and the second hearing aid 121 includes an audio output unit 131, a signal collector 132, an audio signal processor 133, a communication unit 140, a controller 150, and a battery 160. The communication unit 140 includes a transmitter 141 and a receiver 142, and the controller 150 includes a power controller 151. The signal collector 132 may collect an external audio signal. The transmitter 141 may transmit the collected audio signal to a corresponding hearing aid. The receiver 142 may receive an audio signal or a control signal from the corresponding hearing aid. The controller 150 may control an operating mode of the hearing aid 130 in response to the received control signal, and may also control the operating mode based on other conditions, such as, for example, the operating mode of the hearing aid 130 may be controlled using a residual battery quantity measured by the power controller 151. As another non-exhaustive example, the operating mode of the hearing aid 130 may be controlled using a voice activity detector (VAD). The process of controlling the operating mode will be described in detail with reference to FIGS. 2 and 3. The audio signal processor 133 may process the received audio signal using a predetermined signal processing scheme. The audio output unit 131 may output the processed audio signal to a user.

Figure 2:
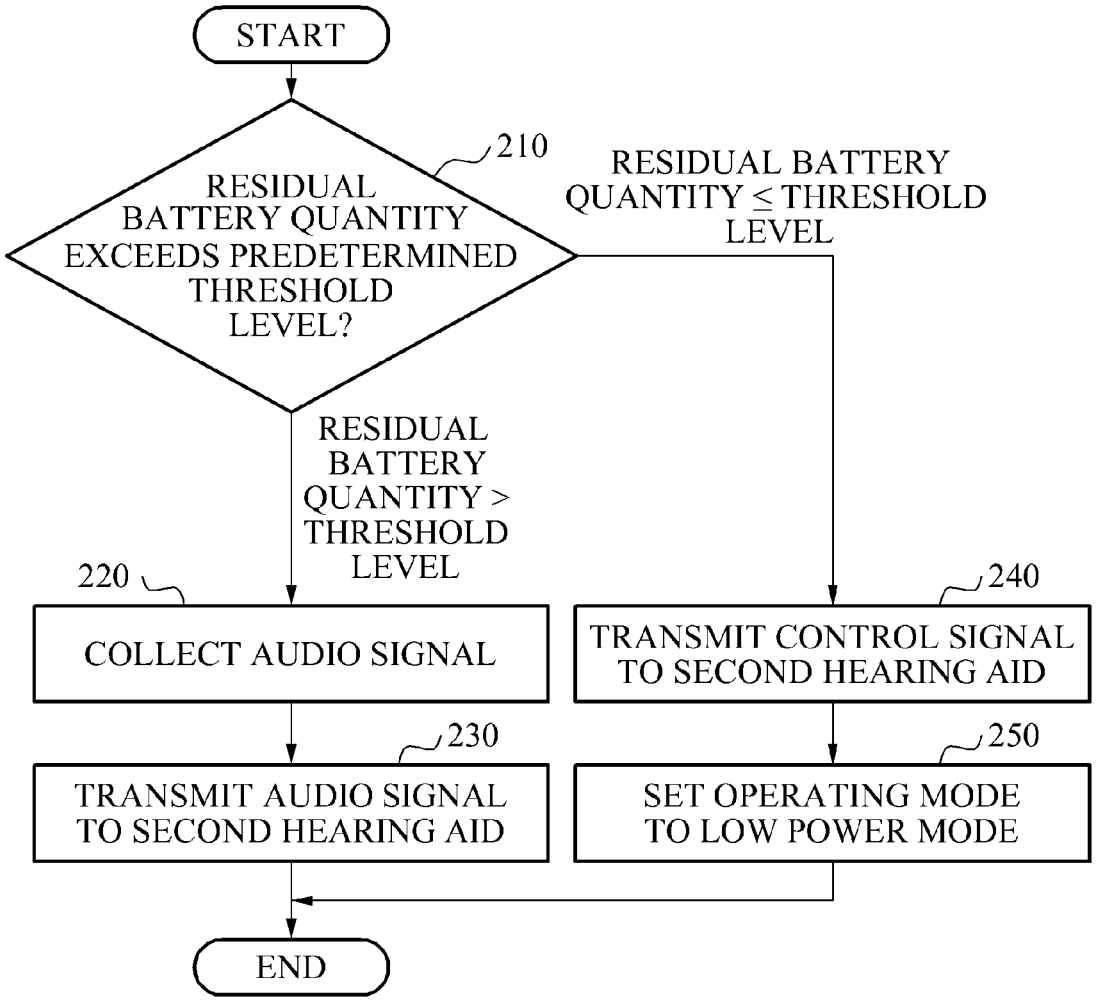
FIG. 2 is a diagram illustrating an example of a method for low power operation of a first hearing aid supporting a binaural function using a residual battery quantity.

FIG. 2 illustrates an example of a method for low power operation of a first hearing aid supporting a binaural function using a residual battery quantity. The operations in FIG. 2 may be performed in the sequence and manner as shown, although the order of some operations may be changed or some of the operations omitted without departing from the spirit and scope of the illustrative examples described. Many of the operations shown in FIG. 2 may be performed in parallel or concurrently.

Referring to FIG. 2, in 210, it is determined whether a residual battery quantity exceeds a predetermined threshold level. For example, the residual battery quantity of the first hearing aid may be verified by a residual battery quantity verifier to determine whether the verified residual battery quantity exceeds the predetermined threshold level. In this example, whether the verified residual battery quantity exceeds the predetermined threshold level may be determined at predetermined intervals. For example, the first hearing aid may determine whether the residual battery quantity exceeds the predetermined threshold level, every 10 milliseconds (ms). In another example, the first hearing aid may determine whether the residual battery quantity exceeds the predetermined level, every 10 ms, in a normal node, whereas the first hearing aid may not determine the residual battery quantity, in a low power mode. The normal mode and the low power mode will be described later.

When it is determined that the residual battery quantity exceeds the predetermined threshold level, in 220, an external audio signal is collected. When the residual battery quantity exceeds the predetermined threshold level, the residual battery quantity is sufficient for the first hearing aid to support the binaural function. To support the binaural function, the first hearing aid may collect an audio signal to be transmitted to a second hearing aid. In this non-exhaustive example, the audio signal may be collected by a signal collecting apparatus.

When an operating mode of the first hearing aid corresponds to a low power mode, and the residual battery quantity of the first hearing aid exceeds the predetermined threshold level, the operating mode may be set to a normal mode in which the binaural function is performed. Accordingly, a state of the first hearing aid may be changed from a state in which the binaural function is suspended to a state in which the binaural function is performed.

In 230, the collected audio signal is transmitted to the second hearing aid from the first hearing aid. This may be needed for performing the binaural function. For example, the first hearing aid may transmit the collected audio signal to the second hearing aid, and the second hearing aid may process the received audio signal, whereby the binaural function may be performed. In this example, a control signal to perform the binaural function may be transmitted to the second hearing aid, along with the audio signal or before the audio signal is transmitted. When an operating mode of the second hearing aid corresponds to a low power mode in which the binaural function is not performed, the second hearing aid may be enabled to perform the binaural function. Accordingly, even when the second hearing aid is in low power mode, the second hearing aid may set the operating mode to a normal mode in response to the received control signal, and may receive the audio signal from the first hearing aid to perform the binaural function. Due to compatibility between the first hearing aid and the second hearing aid, the first hearing aid may also receive an audio signal from the second hearing aid, and may process the received audio signal, similar to the second hearing aid.

When it is determined that the residual battery quantity is less than or equal to the predetermined threshold level, in 240, a control signal to suspend the binaural function is transmitted to the second hearing aid. When the residual battery quantity is less than or equal to the predetermined threshold level, in order to reduce power consumption, the binaural function may be suspended for the first hearing aid and the second hearing aid. A control signal to suspend the binaural function may be transmitted to the second hearing aid, and the second hearing aid receiving the control signal may set the operating mode to a low power mode in response to the received control signal. Here, the low power mode refers to a mode where the binaural function is not performed. The low power mode also refers to controlling the remaining related blocks using a method such as, for example, power shielding for an additional reduction in power consumption. The low power mode may exclude the signal detector.

In 250, the operating mode of the first hearing aid is set to a low power mode where the binaural function is not performed. Operation 250 may be performed for low power operation of the first hearing aid when the residual battery quantity is less than or equal to the predetermined threshold level. In addition, when the residual battery quantity is less than or equal to the predetermined threshold level, an alert including at least one of an alerting sound or an alerting oscillation may be generated. The alert may be used to inform a user that the residual battery quantity is less than or equal to a predetermined level. The user may be made aware that the first hearing aid and the second hearing aid do not support the binaural function. When the residual battery quantity exceeds the predetermined threshold level, through battery charging, battery replacement, or the like, the first hearing aid may resume the binaural function. When a plurality of processors is included in the first hearing aid, operations 210 through 250 may be performed by a predetermined processor.

Figure 3:
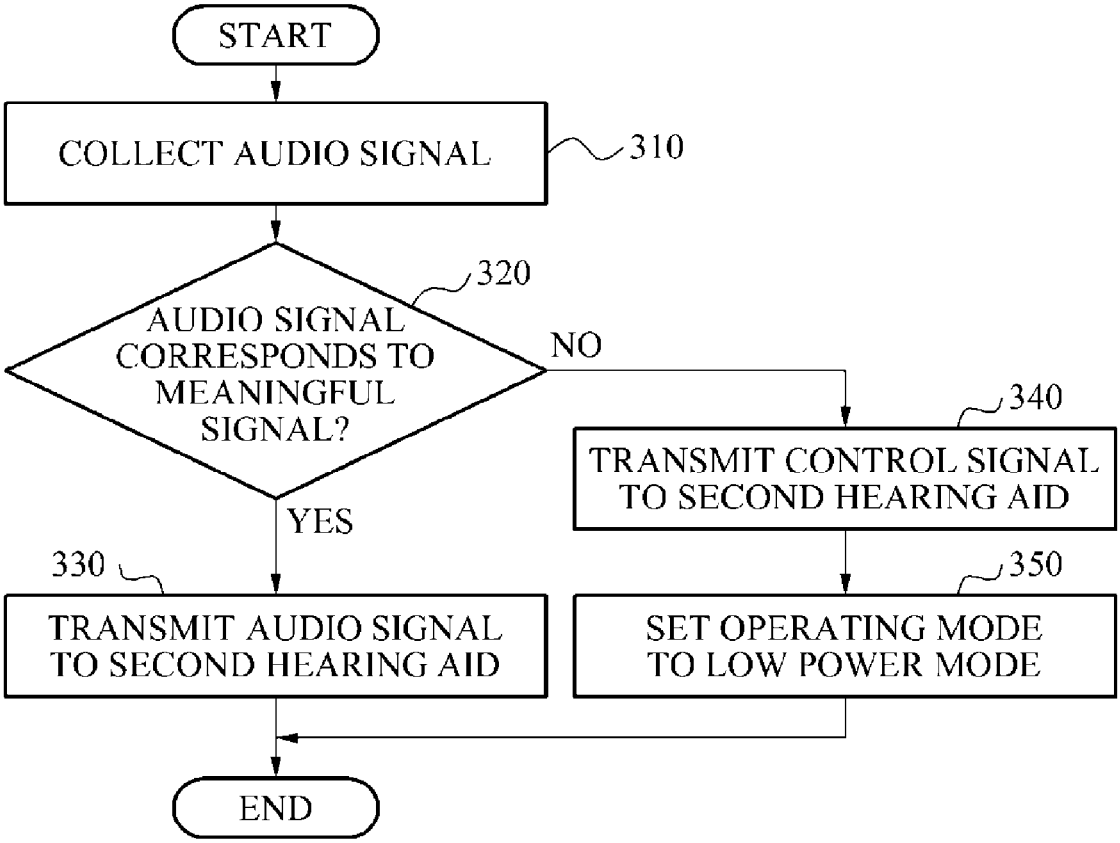
FIG. 3 is a diagram illustrating an example of a method for low power operation of a first hearing aid supporting a binaural function using a determination on a meaningful signal.

FIG. 3 illustrates an example of a method for low power operation of a first hearing aid supporting a binaural function using a determination on a meaningful signal. The operations in FIG. 3 may be performed in the sequence and manner as shown, although the order of some operations may be changed or some of the operations omitted without departing from the spirit and scope of the illustrative examples described. Many of the operations shown in FIG. 3 may be performed in parallel or concurrently.

Referring to FIG. 3, in 310, an external audio signal is collected. As described above, the audio signal may be collected by a signal collecting apparatus in order to perform a binaural function. In this instance, the external audio signal may be collected at predetermined intervals, or it may be collected on an irregular basis.

In 320, whether the collected audio signal corresponds to a meaningful signal is determined, using a Voice Activity Detector (VAD). The VAD may include a detector configured to detect an existence of a meaningful speech signal in an audio signal that may include sounds, such as voices, music, noises, or other sounds. In this non-exhaustive example, the VAD may detect a meaningful speech signal through signal processing in a frequency domain or a time domain. Since there may be a trade-off between the accuracy and complexity of the VAD, the VAD may be implemented in view of desired characteristics, such as, for example, performance, size of a hearing aid, and anticipated sounds. When compared to a general hearing function, the binaural function may be an additional function. Periodically exchanging audio signals while a meaningful audio is absent may be inconsequential. Thus, the binaural function may be performed only when a meaningful audio signal is present.

When it is determined that the audio signal corresponds to a meaningful signal, in 330, the audio signal is transmitted to a second hearing aid from the first hearing aid. When the audio signal corresponds to a meaningful signal, the first hearing aid may transmit the audio signal to the second hearing aid in order to perform the binaural function. The second hearing aid receiving the audio signal may process the received audio signal using a predetermined signal processing method. The first hearing aid may receive the processed audio signal, thereby providing more accurate sounds to the user. In this example, a control signal to perform the binaural function may be transmitted to the second hearing aid, along with the audio signal. In another example, the control signal to perform the binaural function may be transmitted to the second hearing aid before the audio signal is transmitted. When the second hearing aid is in a low power mode, the second hearing aid may be enabled to perform the binaural function. For example, the second hearing aid may set an operating mode to a normal mode in response to the received control signal, and receive the audio signal to perform the binaural function. When the first hearing aid is in a low power mode and the audio signal is determined to correspond to a meaningful signal, an operating mode of the first hearing aid may be set to a normal mode where the binaural function is performed. Thus, a state of the first hearing aid may be changed from a state in which the binaural function is suspended to a state in which the binaural function is performed.

When the audio signal is determined to not correspond to a meaningful signal, in 340, a control signal to suspend the binaural function is transmitted to the second hearing aid. As mentioned above, when the audio signal does not correspond to a meaningful signal, performing the binaural function to exchange the audio signal with the second hearing aid may be inconsequential. Accordingly, the first hearing aid may transmit, to the second hearing aid, the control signal to suspend the binaural function, and the second hearing aid receiving the control signal may set the operating mode to a low power mode in which the binaural function is not performed.

In 350, the operating mode of the first hearing aid is set to a low power mode in which the binaural function is not performed. In this mode, the first hearing aid may not perform the binaural function, but may resume the binaural function when it is determined that the collected audio signal corresponds to a meaningful signal. In an example, when the audio signal is collected at predetermined intervals, whether the audio signal corresponds to a meaningful signal may be determined periodically. When a plurality of processors is included in the first hearing aid, operations 310 through 350 may be performed by a predetermined processor.

A method for low power operation of a first hearing aid supporting a binaural function using a residual battery quantity and a method for low power operation of a first hearing aid supporting a binaural function based on a determination of a meaningful signal may be performed separately or simultaneously.

Figure 4:
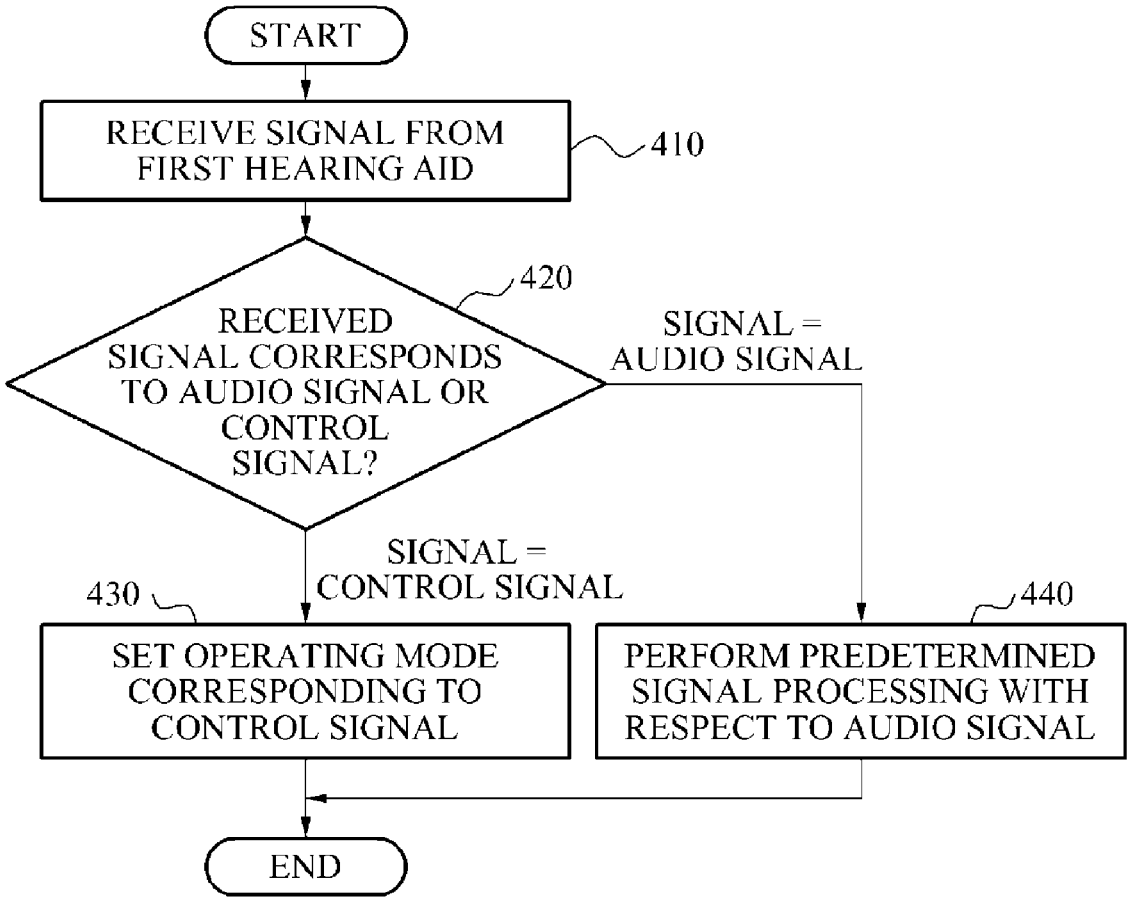
FIG. 4 is a diagram illustrating an example of a method for low power operation of a second hearing aid supporting a binaural function.

FIG. 4 illustrates an example of a method for low power operation of a second hearing aid supporting a binaural function. The operations in FIG. 4 may be performed in the sequence and manner as shown, although the order of some operations may be changed or some of the operations omitted without departing from the spirit and scope of the illustrative examples described. Many of the operations shown in FIG. 4 may be performed in parallel or concurrently.

Referring to FIG. 4, in 410, one of a control signal and an audio signal is received by a second hearing aid from a first hearing aid. When a residual battery quantity of the first hearing aid exceeds a predetermined threshold level, or when the first hearing aid collects a meaningful audio signal, the second hearing aid may receive the audio signal or a control signal to perform a binaural function from the first hearing aid. Conversely When the residual battery quantity of the first hearing aid is less than or equal to the predetermined threshold level, or when the first hearing aid does not collect a meaningful audio signal, the second hearing aid may receive a control signal to suspend the binaural function from the first hearing aid.

In 420, it is determined whether the received signal corresponds to a control signal or an audio signal. Based on the determination, an operating mode of the second hearing aid may be set, and audio signal processing may be performed.

When it is determined that the received signal corresponds to a control signal, in 430, an operation mode is set that corresponds to the control signal. The control signal may include, but is not limited to, a control signal to suspend the binaural function or a control signal to perform the binaural signal. When the control signal corresponds to a control signal to suspend the binaural function, an operating mode of the second hearing aid may be set to a low power mode in which the binaural function is not performed. When the control signal corresponds to a control signal to perform the binaural function, the operating mode of the second hearing aid may be set to a normal mode in which the binaural function is performed. In this mode, the second hearing aid may receive an audio signal from the first hearing aid, and perform audio signal processing with respect to the received audio signal.

When it is determined that the received signal corresponds to an audio signal, in 440, predetermined signal processing is performed with respect to the audio signal. Receipt of an audio signal by the second hearing aid from the first hearing aid indicates that operating modes of the first hearing aid and the second hearing aid correspond to a normal mode. In order to perform the binaural function, the predetermined signal processing may be performed with respect to the audio signal received from the first hearing aid. In an example, the audio signal received from the first hearing aid and an audio signal collected by the second hearing aid may be processed simultaneously, using the predetermined signal processing.

Figure 5:
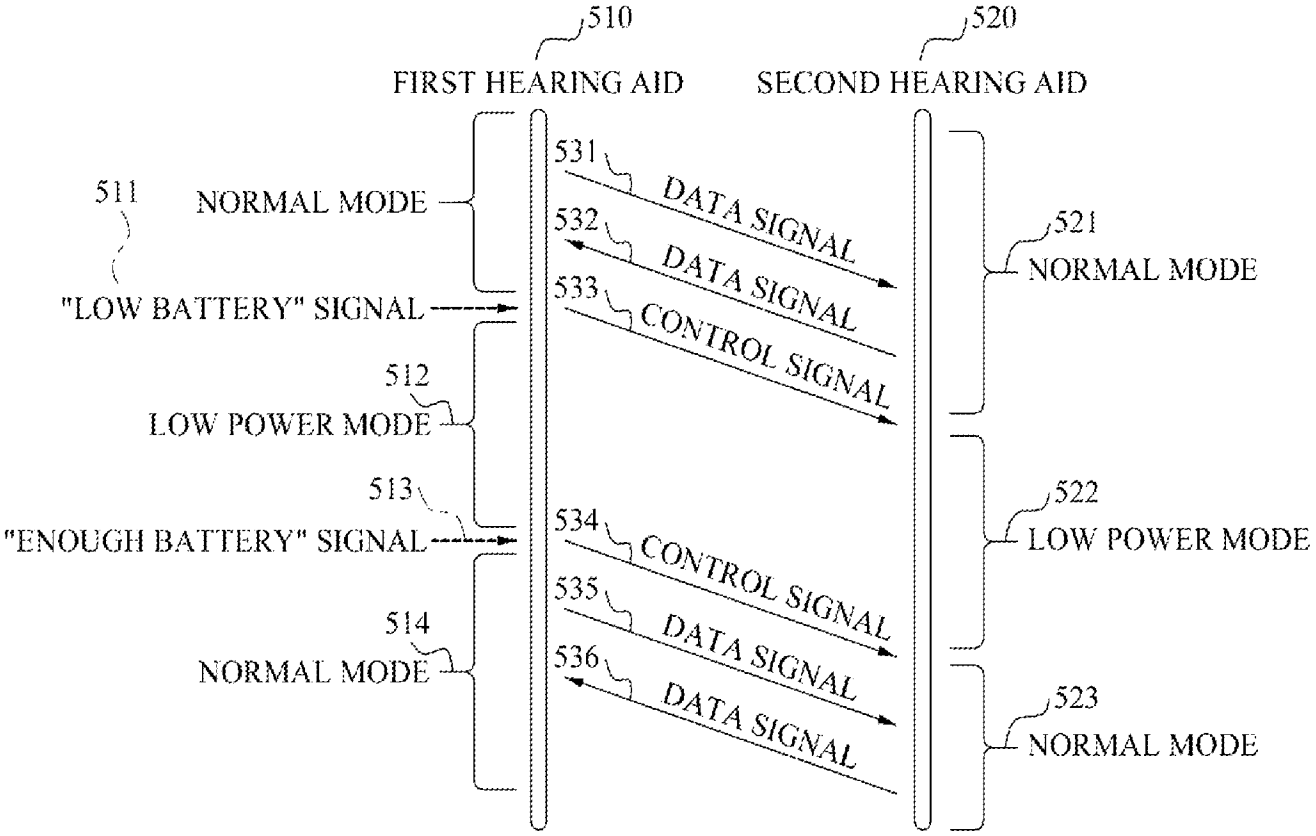
FIG. 5 is a diagram illustrating an example of operations of a first hearing aid and a second hearing aid supporting a binaural function.

FIG. 5 illustrates an example of operations of a first hearing aid 510 and a second hearing aid 520 supporting a binaural function. The operations in FIG. 5 may be performed in the sequence and manner as shown, although the order of some operations may be changed or some of the operations omitted without departing from the spirit and scope of the illustrative examples described. Many of the operations shown in FIG. 5 may be performed in parallel or concurrently.

Referring to FIG. 5, the first hearing aid 510 transmits and receives data signals 531 and 532. In the example shown in FIG. 5, data signal 531 corresponds to audio signal to the second hearing aid 520 and data signal 532 corresponds to audio signal from the second hearing aid 520. In this instance, the first hearing aid 510 and the second hearing aid 520 are in normal modes. The first hearing aid 510 may determine whether a residual battery quantity exceeds a predetermined threshold level. When it is determined that the residual battery quantity is less than or equal to the predetermined threshold level, the first hearing aid 510 generates a "Low Battery" signal 511. The first hearing aid 510 sets an operating mode to a low power mode 512, and transmits, to the second hearing aid 520, a control signal 533 to suspend the binaural function. The second hearing aid 520 changes an operating mode from a normal mode 521 to a low power mode 522, in response to the control signal 533. When a battery of the first hearing aid 510 is charged or replaced, the first hearing aid 510 may determine that the residual battery quantity exceeds the predetermined threshold level. The first hearing aid 510 generates an "Enough Battery" signal 513. The first hearing aid 510 sets the operating mode to a normal mode 514, and transmits, to the second hearing aid 520, a control signal 534 to perform the binaural function. In response to the control signal 534, the second hearing aid 520 sets the operating mode to a normal mode 523. The first hearing aid 510 and the second hearing aid 520 transmit and receive data signals 535 and 536 to perform the binaural function.

Figure 6:
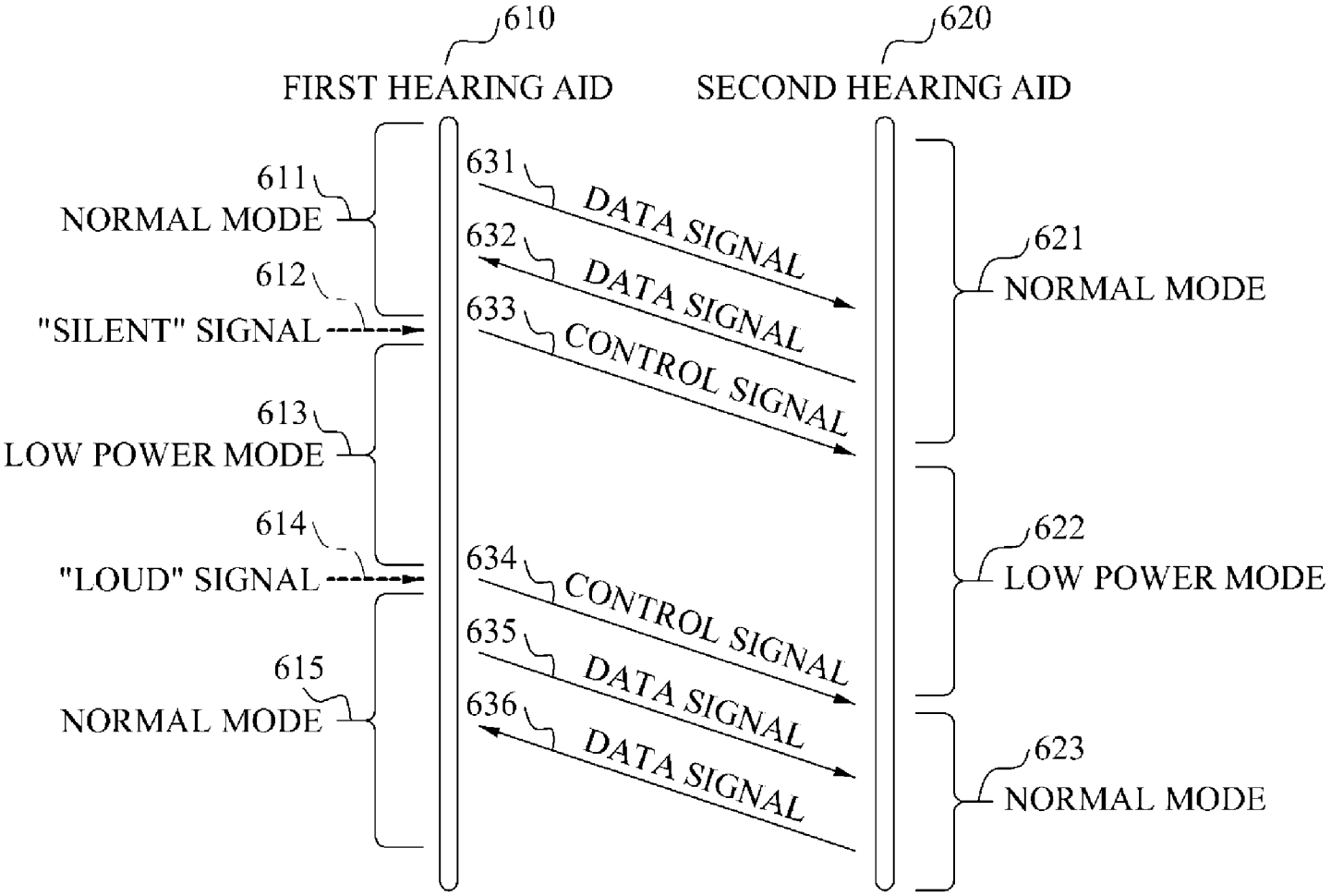
FIG. 6 is a diagram illustrating another example of operations of a first hearing aid and a second hearing aid supporting a binaural function.

FIG. 6 illustrates another example of operations of a first hearing aid 610 and a second hearing aid 620 supporting a binaural function. The operations in FIG. 6 may be performed in the sequence and manner as shown, although the order of some operations may be changed or some of the operations omitted without departing from the spirit and scope of the illustrative examples described. Many of the operations shown in FIG. 6 may be performed in parallel or concurrently.

Referring to FIG. 6, in a normal mode 611 and a normal mode 621, the first hearing aid 610 and the second hearing aid 620 transmit and receive data signals 631 and 632, for example, audio signals, to and from each other, in order to perform the binaural function. The first hearing aid 610 may determine, for example using a VAD, whether an audio signal collected by the first hearing aid 610 corresponds to a meaningful signal. When the audio signal does not correspond to a meaningful signal, the first hearing aid 610 generates a "Silent" signal 612. The first hearing aid 610 sets an operating mode of the first hearing aid 610 to a low power mode 613 where the binaural function is not performed, and transmits to the second hearing aid 620, a control signal 633 to suspend the binaural function. In response to the control signal 633, the second hearing aid 620 changes an operating mode from the normal mode 621 to a low power mode 622. The first hearing aid 610 may continue to collect an audio signal, and when it is determined that the collected audio signal corresponds to a meaningful signal, the first hearing aid 610 generates a "Loud" signal 614. The first hearing aid 610 sets the operating mode to a normal mode 615, and transmits, to the second hearing aid 620, a control signal 634 to perform the binaural function. The second hearing aid 620 sets the operating mode to a normal mode 623, in response to the control signal 634, and transmits and receives data signals 635 and 636 to and from the first hearing aid 610, in order to perform the binaural function.

Figure 7:
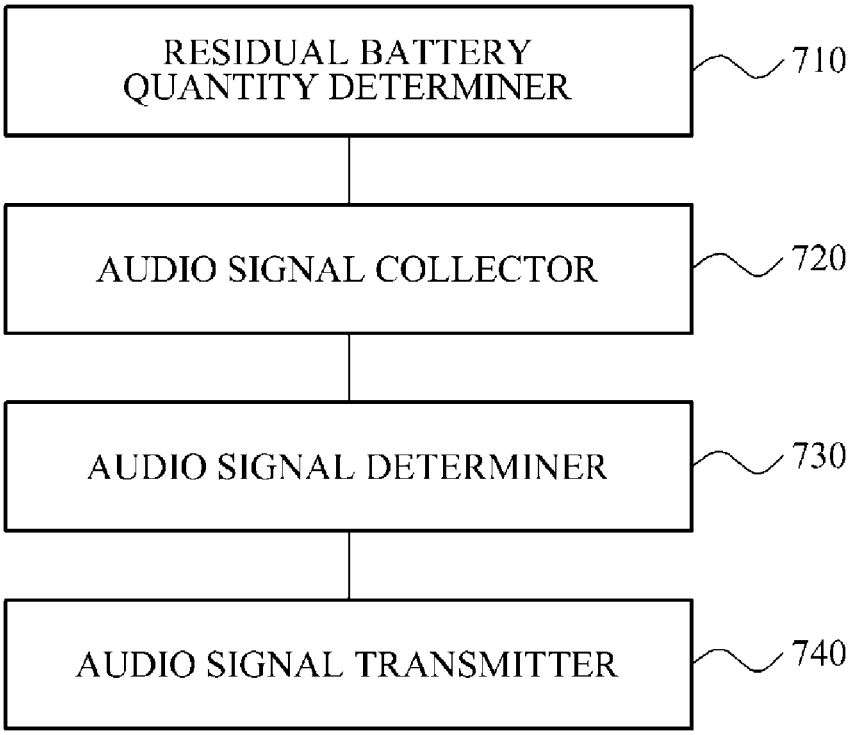
FIG. 7 is a diagram illustrating an example of a first hearing aid supporting a binaural function using a residual battery quantity and a determination on a meaningful signal, simultaneously.

FIG. 7 illustrates an example of a first hearing aid simultaneously supporting a binaural function using a residual battery quantity and a determination of a meaningful signal. The operations in FIG. 7 may be performed in the sequence and manner as shown, although the order of some operations may be changed or some of the operations omitted without departing from the spirit and scope of the illustrative examples described. Many of the operations shown in FIG. 7 may be performed in parallel or concurrently. The above descriptions of FIGS. 1-6 with respect to a first hearing aid is also applicable to FIG. 7, and thus will not be repeated here. Referring to FIG. 7, the first hearing aid includes a residual battery quantity determiner 710, an audio signal collector 720, an audio signal determiner 730, and an audio signal transmitter 740.

The residual battery quantity determiner 710 may determine whether a residual battery quantity exceeds a predetermined threshold level. The audio signal collector 720 may collect an external audio signal, depending on whether the residual battery quantity exceeds the predetermined threshold level. The audio signal determiner 730 may determine whether the collected audio signal corresponds to a meaningful signal, for example, using a VAD. The audio signal transmitter 740 may transmit the audio signal to a second hearing aid (not shown), depending on whether the audio signal corresponds to a meaningful signal.

The methods described above can be written as a computer program, a piece of code, an instruction, or some combination thereof, for independently or collectively instructing or configuring the processing device to operate as desired. Software and data may be embodied permanently or temporarily in any type of machine, component, physical or virtual equipment, computer storage medium or device that is capable of providing instructions or data to or being interpreted by the processing device. The software also may be distributed over network coupled computer systems so that the software is stored and executed in a distributed fashion. In particular, the software and data may be stored by one or more non-transitory computer readable recording mediums. The non-transitory computer readable recording medium may include any data storage device that can store data that can be thereafter read by a computer system or processing device. Examples of the non-transitory computer readable recording medium include read-only memory (ROM), random-access memory (RAM), Compact Disc Read-only Memory (CD-ROMs), magnetic tapes, USBs, floppy disks, hard disks, optical recording media (e.g., CD-ROMs, or DVDs), and PC interfaces (e.g., PCI, PCI-express, WiFi, etc.). In addition, functional programs, codes, and code segments for accomplishing the example disclosed herein can be construed by programmers skilled in the art based on the flow diagrams and block diagrams of the figures and their corresponding descriptions as provided herein.

The apparatuses and units described herein may be implemented using hardware components. The hardware components may include, for example, controllers, sensors, processors, generators, drivers, and other equivalent electronic components. The hardware components may be implemented using one or more general-purpose or special purpose computers, such as, for example, a processor, a controller and an arithmetic logic unit, a digital signal processor, a microcomputer, a field programmable array, a programmable logic unit, a microprocessor or any other device capable of responding to and executing instructions in a defined manner. The hardware components may run an operating system (OS) and one or more software applications that run on the OS. The hardware components also may access, store, manipulate, process, and create data in response to execution of the software. For purpose of simplicity, the description of a processing device is used as singular; however, one skilled in the art will appreciated that a processing device may include multiple processing elements and multiple types of processing elements. For example, a hardware component may include multiple processors or a processor and a controller. In addition, different processing configurations are possible, such a parallel processors.

While this disclosure includes specific examples, it will be apparent to one of ordinary skill in the art that various changes in form and details may be made in these examples without departing from the spirit and scope of the claims and their equivalents. The examples described herein are to be considered in a descriptive sense only, and not for purposes of limitation. Descriptions of features or aspects in each example are to be considered as being applicable to similar features or aspects in other examples. Suitable results may be achieved if the described techniques are performed in a different order, and/or if components in a described system, architecture, device, or circuit are combined in a different manner and/or replaced or supplemented by other components or their equivalents. Therefore, the scope of the disclosure is defined not by the detailed description, but by the claims and their equivalents, and all variations within the scope of the claims and their equivalents are to be construed as being included in the disclosure.

What is claimed is:

1. A method for low power binaural function operation of a first hearing aid, the method comprising:

determining whether a residual battery exceeds a predetermined threshold level;

collecting an external audio signal, in response to determining whether the residual battery exceeds the predetermined threshold level; and transmitting the collected audio signal to a second hearing aid; and transmitting, to the second hearing aid, a control signal to suspend the binaural function, in response to the audio signal not corresponding to a meaningful signal.

2. The method of claim 1, further comprising:

transmitting, to the second hearing aid, a control signal to suspend the binaural function, in response to the residual battery being less than or equal to the predetermined threshold level.

3. The method of claim 1, further comprising:

setting an operating mode to a low power mode in which the binaural function is not performed, in response to the residual battery being less than or equal to the predetermined threshold level.

4. The method of claim 1, further comprising:

generating an alert comprising at least one of an alerting sound or an alerting oscillation, in response to the residual battery being less than or equal to the predetermined threshold level.

5. The method of claim 4, wherein the alert provides information as to whether the first hearing aid and the second hearing aid supports the binaural function.

6. The method of claim 1, wherein the determining comprises determining at predetermined intervals whether the residual battery exceeds the predetermined threshold level.

7. The method of claim 1, wherein the determining comprises determining at irregular intervals whether the residual battery exceeds the predetermined threshold level.

8. The method of claim 1, further comprising:

transmitting, to the second hearing aid, a control signal to perform the binaural function, in response to the residual battery being more than the predetermined threshold level.

9. The method of claim 1, further comprising:

setting an operating mode to a normal mode in which the binaural function is performed, in response to the residual battery being more than the predetermined threshold level.

10. The method of claim 1, further comprising:

receiving, from the second hearing aid, a processed audio signal.

11. The method of claim 10, wherein the processed audio signal comprises the collected audio signal processed by the second hearing aid.

12. The method of claim 10, wherein the processed audio signal comprises the collected audio signal and a audio signal collected by the second hearing aid, which are processed by the second hearing aid.

13. The method of claim 1, further comprising transmitting the control signal along with or before the audio signal.

14. A method for low power binaural function operation of a first hearing aid, the method comprising:

collecting an external audio signal;

determining whether the collected audio signal corresponds to a meaningful signal, using a voice activity detector (VAD);

transmitting the collected audio signal to a second hearing aid, in response to whether the audio signal corresponds to a meaningful signal; and transmitting, to the second hearing aid, a control signal to suspend the binaural function, in response to the audio signal not corresponding to a meaningful signal.

15. The method of claim 14, further comprising:

setting an operating mode to a low power mode in which the binaural function is not performed, in response to the audio signal not corresponding to a meaningful signal.

16. The method of claim 14, wherein the collecting comprises collecting the external audio signal at a predetermined intervals.

17. The method of claim 14, further comprising:

transmitting, to the second hearing aid, a control signal to perform the binaural function, in response to the audio signal corresponding to a meaningful signal.

18. The method of claim 14, further comprising:

setting an operating mode to a normal mode in which the binaural function is performed, in response to the audio signal corresponding to a meaningful signal.

19. A method for low power binaural function operation of a first hearing aid, the method comprising:

determining whether a residual battery exceeds a predetermined threshold level;

collecting an external audio signal, in response to determining whether the residual battery exceeds the predetermined threshold level;

determining whether the collected audio signal corresponds to a meaningful signal, using a voice activity detector (VAD);

transmitting the collected audio signal to a second hearing aid, in response to determining whether the audio signal corresponds to a meaningful signal; and transmitting, to the second hearing aid, a control signal to suspend the binaural function, in response to the audio signal not corresponding to a meaningful signal.

20. A method for low power binaural function operation of a first hearing aid, the method comprising:

receiving a signal from a second hearing aid;

determining whether the received signal corresponds to an audio signal or a control signal; and setting an operating mode corresponding to the control signal, in response to determining whether the received signal corresponds to the audio signal or the control signal, transmitting, to the second hearing aid, a signal to suspend the binaural function, in response to the audio signal not corresponding to a meaningful signal.

21. The method of claim 20, wherein the setting comprises setting the operating mode to a low power mode in which the binaural function is not performed, in response to the control signal corresponding to a control signal to suspend the binaural function.

22. The method of claim 20, wherein the setting comprises setting the operating mode to a normal mode in which the binaural function is performed, in response to the control signal corresponding to a control signal to perform the binaural function.

23. The method of claim 20, further comprising:

performing signal processing with respect to the audio signal, in response to the received signal corresponding to the audio signal.

24. The method of claim 23, wherein the performing signal processing comprises signal processing the received audio signal and an audio signal collected by the first hearing aid.

25. An apparatus for low power binaural function operation, the apparatus comprising:

a residual battery quantity determiner configured to determine whether a residual battery exceeds a predetermined threshold level;

an audio signal collector configured to collect an external audio signal;

an audio signal determiner configured to determine whether the collected audio signal corresponds to a meaningful signal; and an audio signal transmitter configured to transmit at least one of an audio signal or a control signal to a hearing aid, wherein the control signal is configured to suspend the binaural operation in response to the audio signal not corresponding to the meaningful signal.

* * * * *